US007083057B1

(12) United States Patent
Hatch

(10) Patent No.: US 7,083,057 B1
(45) Date of Patent: Aug. 1, 2006

(54) ARTICLE ORGANIZER ASSEMBLY

(76) Inventor: Martin R. Hatch, 1602 Burlington Ave., Lisle, IL (US) 60532

( * ) Notice: Subject to any disclaimer, the term of this patent is extended or adjusted under 35 U.S.C. 154(b) by 0 days.

(21) Appl. No.: 11/321,545

(22) Filed: Dec. 29, 2005

(51) Int. Cl.
*A47H 13/00* (2006.01)

(52) U.S. Cl. ..... 211/120; 211/11; 269/254 CS

(58) Field of Classification Search ..... 211/120, 211/15, 51, 69.8; 40/358, 341, 659; 269/48.4, 269/254 C; 206/425; 220/536
See application file for complete search history.

(56) References Cited

U.S. PATENT DOCUMENTS

| | | | | | |
|---|---|---|---|---|---|
| 428,555 | A | | 5/1890 | Dom | |
| 451,729 | A | | 5/1891 | Dom | |
| 465,070 | A | * | 12/1891 | Trew | 220/572 |
| 550,048 | A | * | 11/1895 | Ketchum | 211/166 |
| D25,926 | S | * | 8/1896 | Elliston | D6/512 |
| 622,864 | A | * | 4/1899 | Rauch | 211/69.9 |
| 863,005 | A | * | 8/1907 | Smith | 211/120 |
| 889,134 | A | * | 5/1908 | Jacoby | 211/120 |
| 1,205,747 | A | * | 11/1916 | Kawate | 211/51 |
| 1,698,396 | A | * | 1/1929 | Ducharme | 211/120 |
| 1,705,339 | A | * | 3/1929 | Plottle | 211/69.8 |
| 2,138,914 | A | * | 12/1938 | Frey | 211/120 |
| 2,270,757 | A | * | 1/1942 | Liska | 40/493 |
| 2,279,643 | A | | 4/1942 | Silver | |
| 2,397,291 | A | * | 3/1946 | Archibald | 248/68.1 |
| 2,522,416 | A | * | 9/1950 | Weiskopf | 118/503 |
| 2,598,610 | A | * | 5/1952 | Satz et al. | 49/463 |
| 2,659,997 | A | * | 11/1953 | Guestinger | 43/57.2 |
| 2,663,114 | A | * | 12/1953 | Warner | 43/54.1 |
| 2,825,467 | A | * | 3/1958 | Fernly | 211/89.01 |
| 2,867,161 | A | * | 1/1959 | Padgett | 396/652 |
| 2,945,251 | A | * | 7/1960 | Eichner | 15/104.92 |
| 3,610,613 | A | * | 10/1971 | Worden | 269/254 R |
| 4,387,477 | A | * | 6/1983 | Eisenberg | 15/104.92 |
| 4,410,093 | A | | 10/1983 | Chiariello et al. | |
| 4,969,561 | A | * | 11/1990 | Yang | 211/59.2 |
| 5,421,466 | A | * | 6/1995 | Hsu | 211/120 |
| 5,816,418 | A | * | 10/1998 | Hsu | 211/120 |

* cited by examiner

*Primary Examiner*—Sarah Purol
*Assistant Examiner*—James C. Dooley
(74) *Attorney, Agent, or Firm*—Christopher J. Scott

(57) ABSTRACT

An article organizer enables a user to organize substantially planar articles and substantially three-dimensional articles adjacent one another. The article organizer comprises a support member and two parallel coils. The support member comprises opposing support ends and a superior support surface. Each support end comprises coil end-retaining structure and each coil comprises opposing coil ends, certain helical structure, and article-receiving gaps. The article-receiving gaps are positioned in side-by-side relation intermediate the helical structure and extend intermediate the opposing support ends. The coil end-retaining structure retains the opposing coil ends for retentively positioning the coils in superior adjacency to the superior support surface, substantially parallel to one another. The article-receiving gaps of the substantially parallel coils cooperate to receive substantially planar articles and the helical structures of the substantially parallel coils cooperate to corral substantially three-dimensional articles upon the superior support surface.

8 Claims, 2 Drawing Sheets

ARTICLE ORGANIZER ASSEMBLY

BACKGROUND OF THE INVENTION

1. Field of the Invention

The present invention generally relates to an assembly for organizing multi-shaped articles. More particularly, the present invention relates to an article organizer assembly for enabling a user to spatially situate planar articles and three-dimensional articles in adjacency to one another for organizing the same.

2. Description of Prior Art

Article organizers are known in the prior art and have been developed in many different forms to achieve many different organizing functions. Some of the more pertinent prior art relating the subject invention are briefly described hereinafter.

U.S. Pat. No. 428,555 ('555 patent), which issued to Dom in 1890, discloses a Paper File. The '555 patent teaches a paper file having spring wire partitions removably connected to a suitable base at an oblique angle thereto. U.S. Pat. No. 451,729 ('729 patent), which issued to Dom in 1891, discloses a Paper or Bill File. The '729 patent teaches a file having a base with longitudinal flanges turned upward, the flanges having recesses in their outer edge, in combination with a partition having vertical portions terminating in angular feet, the vertical and angular portions of the partition resting in and beneath the upwardly turned flanges.

U.S. Pat. No. 2,279,643 ('643 patent), which issued to Silver, discloses a Mail Dispenser. The '643 patent teaches a mail holding device comprising an elongated skeleton frame having parallel longitudinal side members rigidly connected to traverse end members, a centrally disposed longitudinal member disposed intermediate of and spaced from the side longitudinal members and connecting with the end cross members of the frame. The center member is parallel with and in a common plane with the longitudinal side members. Upwardly projecting arms (one formed on each cross member of the frame) and an elongated cylindrical coil of wire are further disclosed. The cylindrical coil of wire is mounted longitudinally on the frame having its ends fastened to the end arms. The coil rests on the side longitudinal members of the frame and the central longitudinal member extends through the lower portion of the coil to firmly connect the coil with the frame. The respective convolutions of the coil are disposed to releasably engage mail matter in transverse position therebetween.

U.S. Pat. No. 4,410,093 ('093 patent), which issued to Chiariello, discloses a Device for Organizing Paper and Files. The '093 patent teaches a device for use as a desk organizer which can be compactly packaged and easily shipped in a knockdown condition, and, which, at the point of use, can be readily assembled without the need for any type of tool. The device comprises a base member, removable end members and a plurality of dividers which can be selectively positioned on the base member. The device further comprises a connector for enabling two of the base members to be interconnected thereby permitting a user to easily double the paper and file holding capacity of the device. Additional connectors can be employed, if desired, to further increase the capacity of the device.

From an inspection of the foregoing disclosures and from a consideration of other art generally known to exist it will be seen that the prior art fails to teach an article organizer assembly comprising a support base and at least two helical coil structures disposed in parallel relation in superior adjacency to the support base for cooperatively receiving planar articles in the respective convolutions of the coils and for corralling three-dimensional articles intermediate the helical structure upon the support surface. The prior art thus perceives a need for an article organizer assembly comprising a support base and at least two helical coil structures disposed in parallel relation in superior adjacency to the support base for cooperatively receiving planar articles in the respective convolutions of the coils and for corralling three-dimensional articles intermediate the helical structure upon the support surface.

SUMMARY OF THE INVENTION

It will thus be seen, in contradistinction to the foregoing prior art, that the present invention provides a novel article organizer assembly for enabling a user to spatially situate substantially planar articles and substantially three-dimensional articles adjacent one another for organizing the articles. The article organizer assembly comprises a substantially planar base member, first and second (extension-type) coil members, four posts, two post cap members, and four post shoes.

The base member comprises a first base end, a second base end, a superior base surface, an inferior base surface, and a base length. The first base end comprises a first aperture pairing and the second base end comprising a second aperture pairing. The first and second aperture pairings each comprise first and second post-receiving apertures. Each post-receiving aperture has a longitudinal aperture axis. The longitudinal aperture axes are orthogonal to the base member and the first and second post-receiving apertures of each aperture pairing are substantially equally spaced from one another.

Each extension coil member comprises first and second coil member ends, helical structure, a relaxed equilibrium state, a tensioned equilibrium state, and a longitudinal coil axis. Each coil member end comprises a post-receiving ring. Each post-receiving ring comprises a longitudinal ring axis, the ring axes being orthogonal to the coil axes. The relaxed equilibrium state coincides with a relaxed coil length and the tensioned equilibrium state coinciding with a tensioned coil length.

The four posts may be categorized into first and second post pairs. Each post pair comprises first and second posts and each post comprises an inferior post end, a superior post end, and a longitudinal post axis. The first posts are received in the first post-receiving apertures and the second posts are received in the second post-receiving apertures. The first and second extension coil members are tensioned from the relaxed equilibrium state to the tensioned equilibrium state thus forming article-receiving gaps intermediate the first and second post-receiving rings of each coil member. The first and second coil ends of the first and second coil members are received by the superior post ends of the first and second posts at the first and second base ends, the ring axes thereby becoming substantially collinear with the aperture axes.

The posts essentially maintain the tensioned equilibrium state. The tensioned coil lengths are substantially equal in magnitude to the base length and the first and second extension coil members being substantially parallel to one another. The article-receiving gaps of the substantially parallel extension coil members cooperate to receive and organize substantially planar articles, the planar articles being substantially orthogonal to the base member. The helical structures of the substantially parallel extension coil members further cooperate to corral three-dimensional articles intermediate the extension coils at the superior base surface.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows.

DETAILED DESCRIPTION OF THE PREFERRED EMBODIMENT

Figure 1:
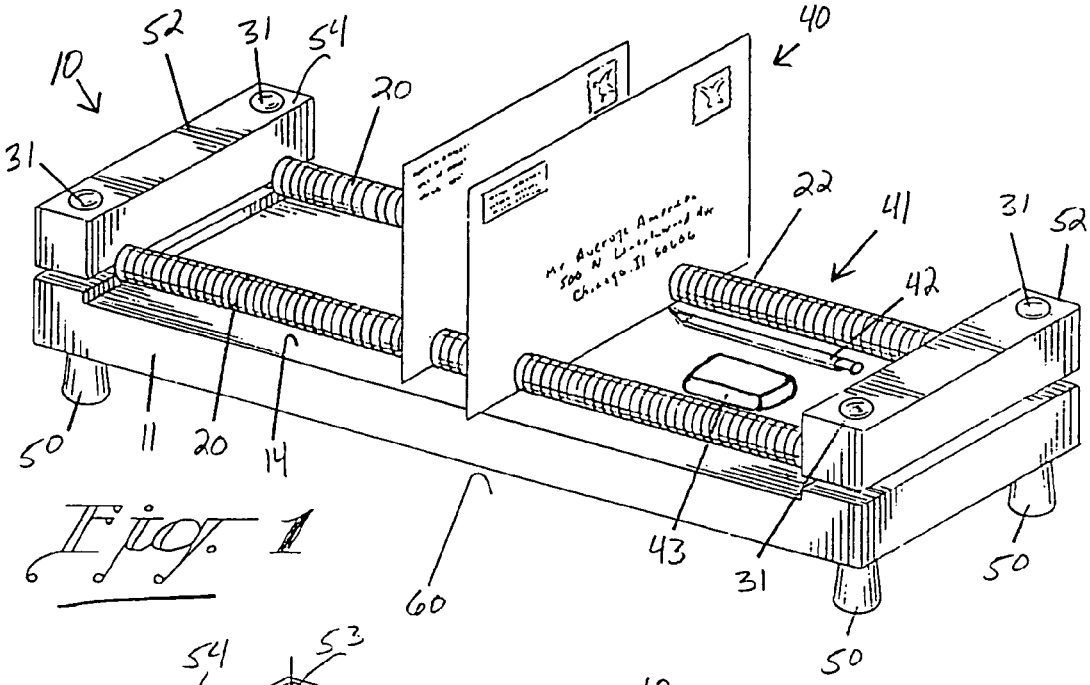
FIG. 1 is a top perspective view of the article organizer assembly of the present invention showing substantially planar articles and substantially three-dimensional articles in organized placement adjacent one another.
Figure 2:
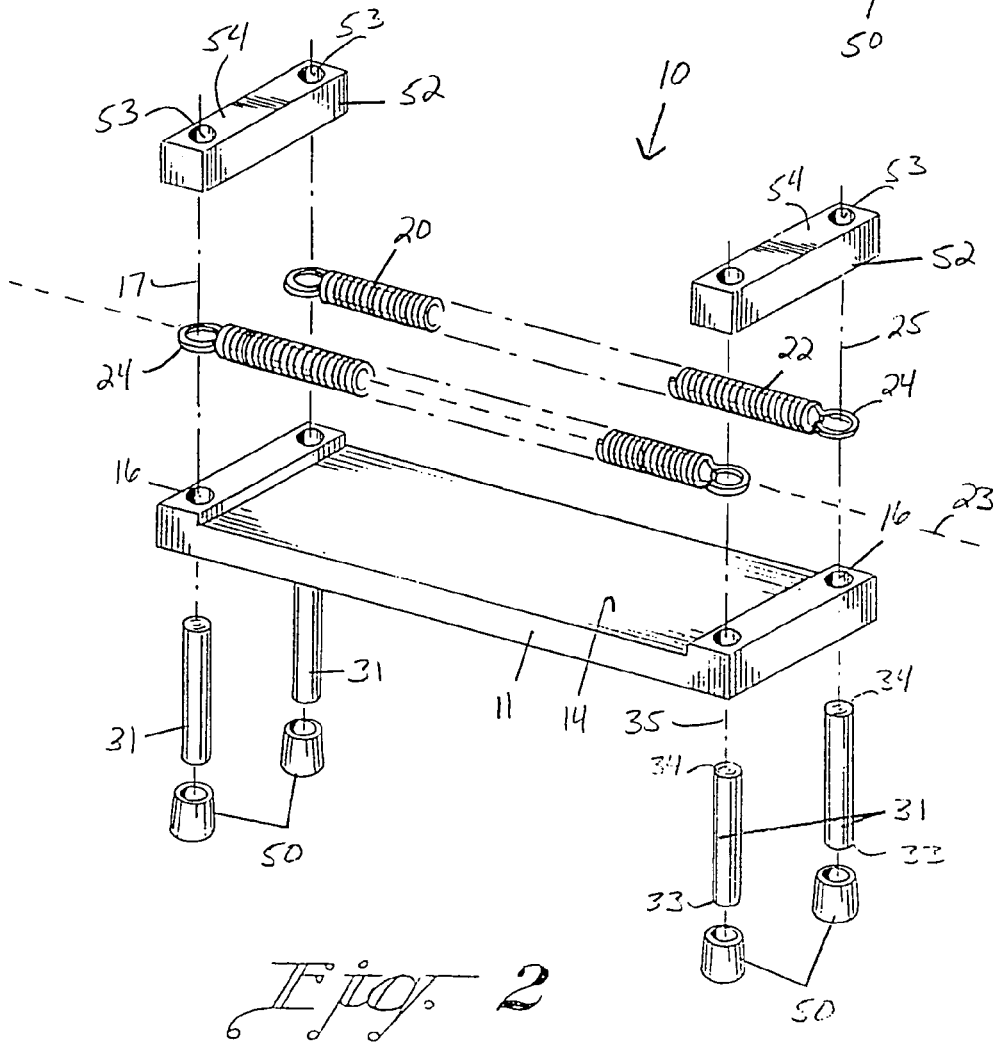
FIG. 2 is an exploded perspective view of the article organizer assembly of the present invention.

Referring now to the drawings, the preferred embodiment of the present invention concerns an article organizer assembly 10 as generally illustrated in assembled form in FIG. 1 and as generally illustrated in exploded form in FIG. 2. Article organizer assembly 10 enables a user to spatially situate or position substantially planar articles 40 (such as mail and other stationary-related articles) and substantially three-dimensional articles 41 (such as writing implements 42, erasers 43, and the like) adjacent one another for organizing the same as generally depicted in FIG. 1. From an inspection of the figures, it will be seen that the article organizer assembly 10 preferably comprises a substantially planar base member 11, two coil members 20, four posts 31, two cap members 52, and four post shoes 50 at as further illustrated and referenced in FIGS. 1 and 2.

Base member 11 is preferably constructed from wood, but could conceivably be constructed from any sturdy, workably type material for supporting small articles such as those hereinabove specified and for retaining the posts 31 or similar other coil end-retaining means as described in more detail hereinafter. Base member 11 preferably comprises opposing first and second base ends, a superior, article-supporting base surface 14, an inferior base surface, and a base length extending intermediate the first and second base ends. The first base end preferably comprises a first aperture or tunnel pairing and the second base end preferably comprising a second aperture or tunnel pairing. The first and second aperture pairings each further comprise first and second post-receiving apertures or tunnels 16. It will thus be understood, that in the preferred embodiment, four post-receiving apertures or tunnels 16 are formed. Preferably, the apertures are through-going apertures or tunnels for receiving a through-going member, such as a post 31, though not necessarily so. Each post-receiving aperture or tunnel 16 inherently has a longitudinal aperture or tunnel axis, one of which has been referenced at 17 in FIG. 2. The aperture or tunnel axes 17 are preferably substantially orthogonal to the plane of the base member 11. The first and second post-receiving apertures or tunnels 16 of each aperture pairing are preferably substantially equally spaced from one another as will be understood from a consideration of the noted figures.

Figure 3:
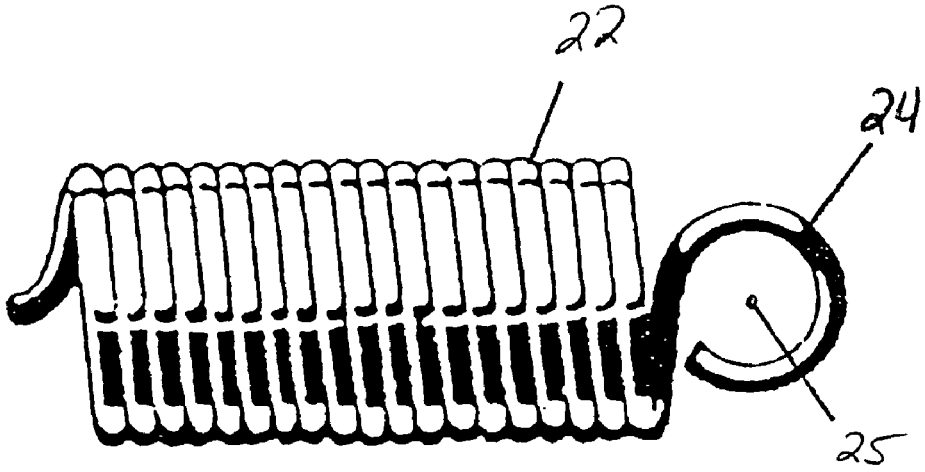
FIG. 3 is a fragmentary top plan view of an extension coil in a relaxed equilibrium state showing a post-receiving ring at one end thereof and certain helical structure.
Figure 4:
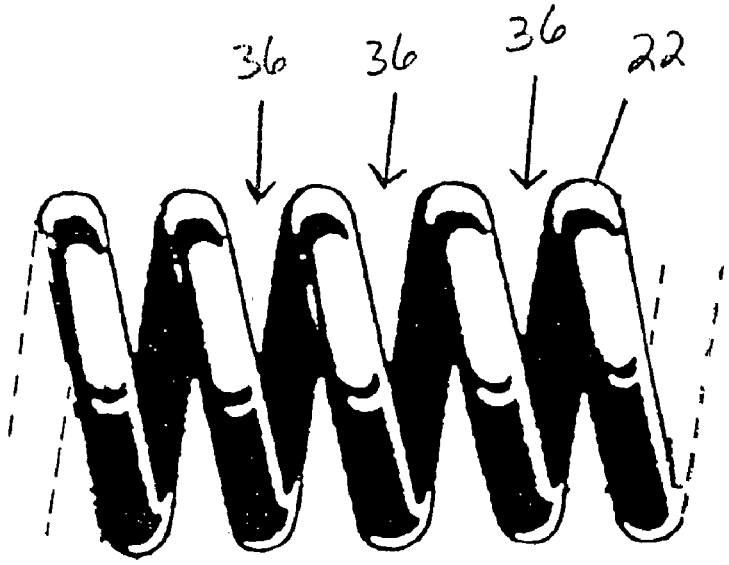
FIG. 4 is a fragmentary side plan view of an extension coil in a tensioned equilibrium state showing article-receiving gaps intermediate the helical structure.

The coil members 20 are preferably of a metallic extension coil type, but not necessarily so. So long at the coil comprises certain helical structure 22 with article-receiving gaps 36 intermediate the helical structure 22 (as most clearly depicted in FIG. 4), it is contemplated that the chosen coil structure will structurally fulfill its purpose. Each coil member 20 inherently comprises opposing first and second coil member ends, certain helical structure 22, a relaxed equilibrium state as generally depicted in FIG. 2; a tensioned equilibrium state as generally depicted in FIG. 1; and a longitudinal coil axis as referenced at 23 in FIG. 2. Each coil member end preferably comprises certain support-attaching means preferably defined by a post-receiving ring 24, two of which have been referenced in FIG. 2 and one of which has been referenced in FIG. 3. The post-receiving rings 24 each comprise a (longitudinal) ring axis as referenced at 25 in FIGS. 2 and 3. It will be seen from an inspection of FIG. 2 that the coil axes 23 are preferably substantially orthogonal to the ring axes 25 and that the tunnel axes are substantially collinear with the ring axes 25. Further, it should be noted that the relaxed equilibrium state essentially coincides with a relaxed coil length (as may be seen from a general inspection of FIG. 2) and that the tensioned equilibrium state essentially coincides with a tensioned coil length (as may be seen from a general inspection of FIG. 1).

Each of the first and second post pairs comprises first and second posts 31, preferably constructed from wood such as may be formed from dowels and the like. Each post 31 inherently comprises an inferior post end 33, a superior post end 34, and a longitudinal post axis as referenced at 35. The post axes 35 are further collinear with the tunnel axes 17 and the ring axes 25 when article organizer assembly 10 is in an assembled state. The posts 31 are sized and shaped to be received in the post-receiving apertures or tunnels 16. Preferably the superior post ends 34 extend upwardly adjacent the superior base surface 14 and the inferior post ends 33 extend downwardly adjacent the inferior base surface.

The first and second extension-type coil members 20 are then tensioned from the relaxed equilibrium state (as further depicted in FIG. 3) to the tensioned equilibrium state (as further depicted in FIG. 4) thereby forming certain article-receiving gaps 36 intermediate the first and second post-receiving rings 24 of each coil member 20. The first and second coil ends of the first and second coil members 20 are received by the superior post ends 34 of the posts 31 at the first and second base ends. The posts 31 are thus designed to maintain the tensioned equilibrium state of the extension coils 20. Notably, the tensioned coil lengths are each substantially equal in magnitude to the base length. Also of particular note is the structural result that the first and second extension coil members 20 are substantially parallel to one another. The article-receiving gaps 36 of opposing or adjacent extension coils 20 are cooperable to receive substantially planar articles 40 as generally depicted in FIG. 1. When received, the articles 40 are substantially orthogonal to the base member 11. Further, the extension coils 20 are cooperable to corral three-dimensional articles 41 intermediate the extension coils 20 upon the superior base surface 14 as further generally depicted in FIG. 1.

As earlier specified, the article organizer assembly 10 may further comprise post shoes 50 and certain cap members 52. The post shoes 50 are preferably of a rubber type and are receivable upon or otherwise cooperable with the inferior post ends 33 for interfacing intermediate the inferior post ends 33 and an organizer support surface 60 as generally further depicted in FIG. 1. It is contemplated that the post shoes 50 may function to prevent damage to both the inferior post ends 33 and the organizer support surface 60 and further to provide a more structurally acceptable coefficient of friction intermediate the inferior post ends 33 and the organizer support surface 60.

The post cap members 52 are preferably constructed from wood or similar other workable material and are cooperatively associated with the superior post ends 33 and the post-receiving rings 24 for locking the extension coils 20 upon the posts 31. Preferably, the post cap members 52 are defined by first and second post cap members 52, whereby each post cap member 52 comprises first and second superior post end-receiving apertures 53 as referenced in FIG. 2, and a superior member surface 54 as further referenced in FIGS. 1 and 2. The superior post ends 33 are thus received by the first and second post cap members 52 and are substantially flush with the superior member surfaces 54 for providing first and second smooth upper end surfaces as may be seen from an inspection of FIG. 1. The smooth upper end surfaces are designed to deflect passing material away from the superior post ends 33 or to otherwise prevent snagging of passing material at the superior post ends 33. Further, the first and second post cap members 52 are cooperable to corral substantially three-dimensional articles 41 upon the superior support surface 14 at the opposing support ends.

It will thus be seen that the article organizer assembly 10 of the present invention enables a user to spatially situate substantially planar articles 40 and substantially three-dimensional articles 41 adjacent one another for organizing the same. The article organizer assembly comprises a support member (such as base member 11) and a pair of coils (such as coil members 20). The support member comprises opposing support ends, and a superior support surface (such as superior base surface 14). Each support end comprises certain coil end-retaining means and each coil comprises opposing coil ends receivable by the coil end-retaining means. In addition, each coil comprises certain helical structure 22, and certain article-receiving gaps 36.

The article-receiving gaps 36 are central to the present invention and are positioned in side-by-side relation intermediate the helical structure, extending intermediate the opposing support ends. Thus, planar articles may be received in the article-receiving gaps 36 with the intervening helical structure for organizing adjacent planar articles. The coil end-retaining means retain the opposing coil ends thus retentively positioning the coils in superior adjacency to the superior support surface. The positioned coils are preferably substantially parallel to one another so that the article-receiving gaps of the substantially parallel coils may cooperate to receive and organize the substantially planar articles. Further, the coils cooperate to corral the substantially three-dimensional articles upon the superior support surface.

While the foregoing descriptions contain much specificity, the same should not be construed as limiting the scope of the invention, but rather as an exemplification of the invention. For example, it is contemplated that the essence of the invention teaches an article organizer for enabling a user to organize substantially planar articles and substantially three-dimensional articles adjacent one another. The article organizer comprises a support member and at least two coils. The support member comprises opposing support ends and a superior support surface. Each support end comprises certain coil end-retaining means.

Each coil comprises opposing coil ends, helical structure, and article-receiving gaps. The article-receiving gaps are positioned in side-by-side relation intermediate the helical structure and extend intermediate the opposing support ends. The coil end-retaining means retain the opposing coil ends for retentively positioning the coils in superior adjacency to the superior support surface substantially parallel to one another. The article-receiving gaps of the substantially parallel coils are cooperable to receive substantially planar articles and the helical structures of the substantially parallel coils are cooperable to corral substantially three-dimensional articles upon the superior support surface. Accordingly, although the invention has been described by reference to a preferred embodiment, it is not intended that the novel assembly be limited thereby, but that modifications thereof are intended to be included as falling within the broad scope and spirit of the foregoing disclosure, the following claims, and the appended drawings.

I claim:

1. An article organizer assembly, the article organizer assembly for enabling a user to spatially situate substantially planar articles and substantially three-dimensional articles adjacent one another for organizing the same, the article organizer assembly comprising:

a substantially planar base member, the base member comprising a first base end, a second base end, a superior base surface, an inferior base surface, and a base length, the first base end comprising a first aperture pairing and the second base end comprising a second aperture pairing, the first and second aperture pairings each comprising first and second post-receiving apertures, each post-receiving aperture having a longitudinal aperture axis, the longitudinal aperture axes being orthogonal to the base member, the first and second post-receiving apertures of each aperture pairing being substantially equally spaced from one another;

first and second extension coil members, each extension coil member comprising a first and second coil member ends, helical structure, a relaxed equilibrium state, a tensioned equilibrium state, and a longitudinal coil axis, each coil member end comprising a post-receiving ring, each post-receiving ring comprising a longitudinal ring axis, the coil axes being orthogonal to the ring axes, the relaxed equilibrium state coinciding with a relaxed coil length, the tensioned equilibrium state coinciding with a tensioned coil length; and first and second post pairs, each post pair comprising first and second posts, each post comprising an inferior post end, a superior post end, and a longitudinal post axis, the first posts being received in the first post-receiving apertures and the second posts being received in the second post-receiving apertures, the first and second extension coil members being tensioned from the relaxed equilibrium state to the tensioned equilibrium state thus forming article-receiving gaps intermediate the first and second post-receiving rings of each coil member, the first and second coil ends of the first and second coil members being received by the superior post ends of the first and second posts at the first and second base ends, the ring axes being substantially collinear with the aperture axes, the posts for maintaining the tensioned equilibrium state, the tensioned coil lengths being substantially equal in magnitude to the base length, the first and second extension coil members being substantially parallel to one another, the article-receiving gaps of the substantially parallel extension coil members being cooperable to receive and organize substantially planar articles, the planar articles being substantially orthogonal to the base member, the helical structures of the substantially parallel extension coil members being cooperable to corral three-dimensional articles intermediate the extension coils at the superior base surface.

2. The article organizer assembly of claim 1 comprising post shoes, the inferior post ends extending downwardly adjacent the inferior base surface, the post shoes being cooperable with the inferior post ends for interfacing intermediate the inferior post ends and an organizer support surface, the post shoes for preventing damage to the inferior post ends and the organizer support surface.

3. The article organizer assembly of claim 1 comprising post caps, the post caps being cooperatively associated with the superior post ends and the post-receiving rings for locking the extension coil members upon the posts.

4. The article organizer assembly of claim 3 wherein the post caps are defined by first and second post cap members, each post cap member comprising first and second superior post end-receiving apertures and a superior member surface, the superior post ends being received by the first and second post cap members, the superior post ends being substantially flush with the superior member surfaces for providing first and second smooth upper end surfaces, the smooth upper end surfaces for deflecting material away from the superior post ends.

5. The article organizer assembly of claim 4 wherein the first and second post cap members are cooperable to corral the substantially three-dimensional articles upon the superior support surface at the first and second base ends.

6. An article organizer, the article organizer for enabling a user to organize substantially planar articles and substantially three-dimensional articles adjacent one another, the article organizer comprising a support member, at least two coils, and a plurality of post caps, the support member comprising opposing support ends, a superior support surface, each support end comprising a plurality of posts, each coil comprising opposing coil ends, helical structure, and article-receiving gaps, the coil ends each comprising a post-receiving ring, a post being cooperatively associated with each post-receiving ring for retaining the opposing coil ends, the post caps being cooperatively associated with the posts and the post-receiving rings for locking the coils upon the posts, the article-receiving gaps being positioned in side-by-side relation intermediate the helical structure and extending intermediate the opposing support ends, the posts retaining the opposing coil ends thus retentively positioning the coils in superior adjacency to the superior support surface, the positioned coils being substantially parallel to one another, the article-receiving gaps of the substantially parallel coils being cooperable to receive substantially planar articles, the helical structures of the substantially parallel coils being cooperable to corral substantially three-dimensional articles upon the superior support surface.

7. The article organizer of claim 6 wherein the post caps are defined by first and second post cap members, each post cap member comprising first and second superior post end-receiving apertures, the superior post ends being received in the superior post end-receiving apertures, first and second post cap members being cooperable to corral the substantially three-dimensional articles upon the superior support surface at the opposing support ends.

8. An article organizer, the article organizer for enabling a user to organize substantially planar articles and substantially three-dimensional articles adjacent one another, the article organizer comprising a support member, at least two coils, and at least two post caps, the support member comprising opposing support ends and a superior support surface, each support end comprising a plurality of posts and post-receiving tunnels, the posts extending through the post-receiving tunnels and comprising a superior post end and an inferior post end, each coil comprising opposing coil ends, helical structure, and article-receiving gaps, the coil ends each comprising a post-receiving ring, a post being cooperatively associated with each post-receiving ring for retaining the opposing coil ends, the post caps being cooperatively associated with the posts and the post-receiving rings for locking the coils upon the posts, the article-receiving gaps being positioned in side-by-side relation intermediate the helical structure and extending intermediate the opposing support ends, the posts retaining the opposing coil ends thus retentively positioning the coils in superior adjacency to the superior support surface, the positioned coils being substantially parallel to one another, the inferior post ends extending downwardly from the support member, each inferior post end being outfitted with a post shoe, the post shoes being cooperatively associated with the inferior post ends for interfacing intermediate the inferior post ends and an organizer support surface, the post shoes for preventing damage to the inferior post ends and the organizer support surface, the article-receiving gaps of the substantially parallel coils being cooperable to receive substantially planar articles, the helical structures of the substantially parallel coils being cooperable to corral substantially three-dimensional articles upon the superior support surface.

* * * * *